US009399808B2

(12) United States Patent
Matsumoto et al.

(10) Patent No.: US 9,399,808 B2
(45) Date of Patent: Jul. 26, 2016

(54) ALUMINUM ALLOY SHEET EXCELLENT IN BAKING FINISH HARDENABILITY

(75) Inventors: Katsushi Matsumoto, Kobe (JP); Yasuhiro Aruga, Kobe (JP); Hidemasa Tsuneishi, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 149 days.

(21) Appl. No.: 14/004,456

(22) PCT Filed: Mar. 13, 2012

(86) PCT No.: PCT/JP2012/056370

§ 371 (c)(1), (2), (4) Date: Sep. 11, 2013

(87) PCT Pub. No.: WO2012/124676

PCT Pub. Date: Sep. 20, 2012

(65) Prior Publication Data

US 2014/0003993 A1 Jan. 2, 2014

(30) Foreign Application Priority Data

Mar. 15, 2011 (JP) ..... 2011-056960

(51) Int. Cl.

| | |
|---|---|
| ***C22C 21/08*** | (2006.01) |
| ***C22C 21/04*** | (2006.01) |
| ***C22C 21/02*** | (2006.01) |
| ***C22F 1/043*** | (2006.01) |
| ***C22F 1/047*** | (2006.01) |
| ***C22F 1/05*** | (2006.01) |
| ***C22C 21/10*** | (2006.01) |
| ***C22C 1/02*** | (2006.01) |
| *C22F 1/00* | (2006.01) |

(52) U.S. Cl.

CPC . *C22C 21/04* (2013.01); *C22C 1/02* (2013.01); *C22C 21/02* (2013.01); *C22C 21/08* (2013.01); *C22C 21/10* (2013.01); *C22F 1/043* (2013.01); *C22F 1/047* (2013.01); *C22F 1/05* (2013.01); *C22F 1/00* (2013.01)

(58) Field of Classification Search

CPC ..... C22C 21/08; C22F 1/05

See application file for complete search history.

(56) References Cited

U.S. PATENT DOCUMENTS

| | | | | |
|---|---|---|---|---|
| 5,266,130 | A | 11/1993 | Uchida et al. | |
| 5,718,780 | A | 2/1998 | Bryant et al. | |
| 2009/0242088 | A1 * | 10/2009 | Takaki et al. | 148/693 |

FOREIGN PATENT DOCUMENTS

| | | | |
|---|---|---|---|
| CN | 101550509 | A | 10/2009 |
| JP | 4 210456 | | 7/1992 |
| JP | 2614686 | | 5/1997 |
| JP | 10 219382 | | 8/1998 |
| JP | 2000 160310 | | 6/2000 |
| JP | 3207413 | | 9/2001 |
| JP | 2005 139537 | | 6/2005 |
| JP | 2006 9140 | | 1/2006 |
| JP | 2007 169740 | | 7/2007 |
| JP | 2009 242904 | | 10/2009 |
| KR | 10-2009-0104739 | A | 10/2009 |
| WO | WO 97/22724 | A1 | 6/1997 |

OTHER PUBLICATIONS

Extended European Search Report issued Sep. 22, 2014 in Patent Application No. 12757501.7.

"International Alloy Designations and Chemical Composition Limits for Wrought Aluminum and Wrought Aluminum Alloys with Support for On-line Access From: Aluminum Extruders Council Aluminium Federation of South Africa Australian Aluminium Council Ltd. European Aluminium Associaton Japan Aluminium Ass", XP055136121, Feb. 1, 2009, Retrieved from the Internet: URL:http://www.aluminum.org/sites/default/ files/Teal_Sheets.pdf.

Yucel Birol et al., "Pre-aging Improve Bake Hardening in a Twin-roll Cast Al—Mg—Si Alloy", Materials Science and Engineering, vol. 391, No. 1-2, XP027790682, Jan. 25, 2005, pp. 175-180.

Chin-Hui Shen et al., "Pre-ageing to Improve the Microstructure and Tensile Properties of Al-0.72Mg-0.42Si-0.1Cu Artificially Aged Alloy", Canadian Metallurgical Quarterly, vol. 47, No. 4, XP009179776, Oct. 1, 2008, pp. 449-458.

J. M. Hyde et al., "A Sensitivity Analysis of the Maximum Separation Method for the Characterisation of Solute Clusters", Ultramicroscopy, XP055136022, vol. 111, No. 6, May 1, 2011, pp. 440-447.

M. Murayama et al., "Pre-precipitate Clusters and Precipitation Processes in Al—Mg—Si Alloys", XP027395698, vol. 47, No. 5, Mar. 31, 1999, pp. 1537-1548.

* cited by examiner

*Primary Examiner* — Roy King
*Assistant Examiner* — Janelle Morillo
(74) *Attorney, Agent, or Firm* — Oblon, McClelland, Maier & Neustadt, L.L.P.

(57) ABSTRACT

This aluminum alloy sheet has increased BH properties under low-temperature short-time-period conditions after long-term room-temperature aging by means of causing aggregates of specific atoms to be contained having a large effect in BH properties, the distance between atoms being no greater than a set distance, and containing either Mg atoms or Si atoms measured by 3D atom probe field ion microscopy in a 6000 aluminum alloy sheet containing a specific amount of Mg and Si.

7 Claims, No Drawings

ALUMINUM ALLOY SHEET EXCELLENT IN BAKING FINISH HARDENABILITY

TECHNICAL FIELD

The present invention relates to an Al—Mg—Si-based aluminum alloy sheet. The aluminum alloy sheet referred to in the present invention means an aluminum alloy sheet that is a rolled sheet such as a hot rolled sheet, a cold rolled sheet and the like and is subjected to refining such as solution heat treatment, quenching treatment and the like. Further, aluminum is hereinafter also referred to as Al.

BACKGROUND ART

In recent years, because of consideration for global environment and the like, the social requirement of weight reduction of a vehicle such as an automobile and the like has been increasing more and more. In order to respond to such requirement, as a material for a large body panel (outer panel, inner panel) of an automobile panel such as a hood, door, roof and the like in particular, instead of a steel material such as a steel sheet and the like, application of an aluminum alloy material excellent in formability and baking finish hardenability and lighter in weight has been increasing.

Among them, for a panel such as an outer panel (outer sheet), inner panel (inner sheet) and the like of a panel structural body such as a hood, fender, door, roof, trunk lid and the like of an automobile, as a thin and high strength aluminum alloy sheet, use of an Al—Mg—Si-based AA or JIS 6000 series (may also be hereinafter simply referred to as a 6000 series) aluminum alloy sheet has been studied.

This 6000 series aluminum alloy sheet contains Si and Mg as inevitable elements, and an excess-Si type 6000 series aluminum alloy in particular has a composition of 1 or more Si/Mg mass ratio and has excellent age-hardenability. Therefore, it has baking finish hardenability (may also be hereinafter referred to as bake hardenability=BH properties and bake hardenability) with which formability is secured by lowering the proof stress in press forming and bending work, age hardening occurs by heating in artificial aging (hardening) treatment at a comparatively low temperature such as bake finish treatment of a panel after forming and the like to improve the proof stress, and the strength required as a panel can be secured.

Also, in the 6000 series aluminum alloy sheet, the alloy element amount is comparatively less in comparison to other 5000 series aluminum alloy and the like with much alloy amount of Mg amount and the like. Therefore, when the scrap of these 6000 series aluminum alloy sheets are reused as an aluminum alloy melting material (melting raw material), an original 6000 series aluminum alloy ingot is easily obtained, and recycling performance is also excellent.

On the other hand, as is known well, an outer panel of an automobile is manufactured by subjecting an aluminum alloy sheet to combined forming work such as stretch forming, bending forming and the like in press forming. For example, in a large outer panel such as a hood, door and the like, the shape is made a formed product shape as an outer panel by press forming such as stretching and the like, then joining with an inner panel is executed by hem working (hemming) of a flat hem and the like of the outer panel peripheral section to be formed into a panel structural body.

Here, the 6000 series aluminum alloy had an advantage of having excellent BH properties, but had a problem of having aging property at room temperature, age hardening in retention at room temperature for several months after solution heat treatment and quenching treatment to increase the strength, and thereby deteriorating the formability into a panel particularly the bending workability. For example, when a 6000 series aluminum alloy sheet is to be used for an automobile panel use, the sheet is placed at room temperature (left at room temperature) for approximately 1-4 months normally after solution heat treatment and quenching treatment (after manufacturing) at an aluminum manufacturer until forming work into a panel at an automobile manufacturer, and comes to be significantly age hardened (room temperature aging) during that time. Particularly in the outer panel subjected to severe bending work, there was such a problem that, although forming was possible without any problem after the lapse of 1 month after manufacturing, a crack occurred in hem working after the lapse of 3 months. Therefore, in the 6000 series aluminum alloy sheet for an automobile panel particularly for an outer panel, it is necessary to suppress room temperature aging over a comparatively long period of approximately 1-4 months.

Also, when such room temperature aging is large, such a problem also occurs that the BH properties deteriorate and the proof stress does not improve to the strength required as a panel by heating at the time of artificial aging (hardening) treatment at a comparatively low temperature such as baking finish treatment and the like of the panel after forming described above.

Therefore, with respect to improvement of the BH properties and suppression of room temperature aging of the 6000 series aluminum alloy, various proposals have been made from the past. For example, in Patent Literature 1, a proposal has been made in which strength variation at room temperature from the lapse of 7 days to 90 days after manufacturing is suppressed by changing the cooling rate stepwise at the time of solution heat treatment and quenching treatment. Also, in Patent Literature 2, a proposal has been made in which the BH properties and shape fixability are secured by being retained for 10-300 min at 50-150° C. temperature within 60 min after solution heat treatment and quenching treatment. Further, in Patent Literature 3, a proposal has been made in which the BH properties and shape fixability are secured by stipulating the cooling rate of the first step and the cooling rate thereafter at the time of solution heat treatment and quenching treatment.

Also, in Patent Literature 4, improvement of the BH properties in heat treatment after solution heat treatment and quenching treatment has been proposed. In Patent Literature 5, improvement of the BH properties by the stipulation of the endothermic peak of a DSC (Differential scanning calorimetry) method has been proposed. In Patent Literature 6, improvement of the BH properties by the stipulation of the exothermic peak of the same DSC has been proposed.

However, in these Patent Literatures 1-6, with respect to the cluster (aggregate of atoms) directly affecting the BH properties and aging property at room temperature of the 6000 series aluminum alloy sheet, the behavior thereof was merely indirectly reasoned by analogy.

On the other hand, in Patent Literature 7, a trial has been made in which the cluster (aggregates of atoms) affecting the BH properties and aging property at room temperature of the 6000 series aluminum alloy sheet has been directly measured and stipulated. More specifically, the average number density of the clusters whose circle equivalent diameter is within the range of 1-5 nm out of the clusters (aggregates of atoms) observed in analysis of the microstructure of a 6000 series aluminum alloy sheet by a transmission electron microscope of 1,000,000 magnifications has been stipulated in the range of 4,000-30,000 pieces/pmt to obtain one with excellent BH properties and suppressed room temperature aging.

CITATION LIST

Patent Literature

Patent Literature 1: Japanese Unexamined Patent Application Publication No. 2000-160310

Patent Literature 2: Japanese Patent No. 3207413

Patent Literature 3: Japanese Patent No. 2614686

Patent Literature 4: Japanese Unexamined Patent Application Publication No. H4-210456

Patent Literature 5: Japanese Unexamined Patent Application Publication No. H10-219382

Patent Literature 6: Japanese Unexamined Patent Application Publication No. 2005-139537

Patent Literature 7: Japanese Unexamined Patent Application Publication No. 2009-242904

SUMMARY OF INVENTION

Technical Problems

However, the BH properties after room temperature aging according to these prior arts still have a room for improvement under a condition the vehicle body baking finish treatment is shortened at a lower temperature in order to increase the efficiency of a manufacturing line for an automobile vehicle body. More specifically, improvement of the BH properties after room temperature aging when the vehicle body baking finish treatment according to these prior arts is shortened at a lower temperature such as 150° C.×20 min and the like is approximately 30-40 MPa in terms of 0.2% proof stress, and higher BH properties are required.

In view of such problems, the object of the present invention is to provide an Al—Si—MG-based aluminum alloy sheet capable of exerting high BH properties even in the vehicle body baking finish treatment under the condition of being shortened at a lower temperature after room temperature aging.

Solution to Problems

In order to achieve the project, an aspect of the aluminum alloy sheet of the present invention is an Al—Mg—Si-based aluminum alloy sheet excellent in baking finish hardenability containing Mg: 0.2-2.0% and Si: 0.3-2.0% in mass % with the remainder being Al and inevitable impurities, in which an aggregate of atoms measured by a three-dimensional atom probe field ion microscope contains either of Mg atoms or Si atoms or both of them by 30 pieces or more in total, when any atom of the Mg atom or the Si atom contained therein is made a reference, the distance between the atom of the reference and either atom out of neighboring other atoms is 0.75 nm or less, and the aggregates of atoms satisfying these conditions are contained by average number density of $1.0\times10^5$ pieces/$\mu m^3$ or more.

Advantageous Effects of Invention

It is known that, in a 6000 series aluminum alloy, Mg and Si form aggregates of atoms called a cluster during retention at room temperature or heat treatment at 50-150° C. after solution heat treatment and quenching treatment. However, the cluster formed during retention at room temperature and that during heat treatment at 50-150° C. are entirely different from each other in the behavior (characteristic) thereof.

The cluster formed by retention at room temperature suppresses precipitation of a GP zone or a β' phase which increases the strength in artificial aging or baking finish treatment thereafter. On the other hand, it is shown that the cluster (or Mg/Si cluster) formed at 50-150° C. promotes precipitation of the GP zone or the β' phase adversely (described for example in Yamada et al., Keikinzoku (Light Metal), vol. 51, p. 215).

In the meantime, in the Patent Literature 7, in paragraphs 0021-0025 thereof, it is described that these clusters were analyzed by measurement of specific heat, a 3 DAP (three-dimensional atom probe) and the like in the past. Also, at the same time, it is described that, by analysis of the cluster by the 3 DAP, although presence of the cluster itself was confirmed by being observed, the size and number density of the cluster stipulated in the present invention were unclear or could be measured only limitedly.

It is certain that analysis of the cluster by the 3 DAP (three-dimensional atom probe) has been tried from the past with respect to the 6000 series aluminum alloy. However, as described in the Patent Literature 7, even though presence of the cluster itself was confirmed, the size and number density of the cluster were unclear.

The reason is that it was unclear which cluster among the aggregates of atoms (clusters) measured by the 3 DAP and the BH properties were largely correlated, and it was unclear which were the aggregates of atoms that largely related to the BH properties.

On the other hand, the present invention clarified it, and it was found out that such a specific cluster in which Mg atoms or Si atoms were contained by a specific amount or more in total and the distance between the neighboring atoms contained therein was a specific value or less as the stipulation among the aggregates of atoms (clusters) measured by the 3 DAP and the BH properties were largely correlated. Also, it was found out that high BH properties could be exerted by increasing the number density of the aggregates of atoms satisfying these conditions even in the vehicle body baking finish treatment under a condition shortened at a low temperature after room temperature aging.

Therefore, according to the present invention, even when room temperature aging is effected and the vehicle body baking finish treatment is shortened at a low temperature such as 150° C.×20 min and the like, an Al—Si—Mg-based aluminum alloy sheet capable of exerting higher BH properties can be provided.

DESCRIPTION OF EMBODIMENTS

Below, embodiments of the present invention will be specifically described for respective requirements.

(Measurement Principle and Measurement Method of 3 DAP)

The 3 DAP (three-dimensional atom probe) is a field ion microscope (FIM) attached with a time of flight mass spectrometer. It is a local analyzer capable of observing respective atoms on the metal surface by the field ion microscope and identifying these atoms by time of flight mass spectrometry with such the constitution. Also, the 3 DAP becomes a means very effective for structural analysis of the aggregates of atoms because it can simultaneously analyze the kind and position of atoms emitted from the sample. Therefore, as described above, it is used for analysis of the microstructure of a magnetic recording film, an electronic device, steel or the like as a widely known technology. Further, recently, it is also used for determination of the cluster of the microstructure of an aluminum alloy sheet and the like as described above.

This 3 DAP utilizes an ionizing phenomenon of sample atoms themselves under a high electric field which is called electric field evaporation. When high voltage required by the sample atoms for electric field evaporation is applied to the sample, atoms are ionized from the sample surface, pass through a probe hole, and reach a detector.

This detector is a position sensitive detector, carries out mass spectroscopy of respective ions (identification of elements that are atomic species), measures the time of flight until each ion reaches the detector, and can thereby simultaneously determine the detected position (atomic structural position). Accordingly, the 3 DAP can simultaneously measure the position and the atomic species of the atom at the tip of the sample, and therefore has the feature of being able to three-dimensionally reconstitute and observe the atomic structure of the tip of the sample. Also, because electric field evaporation takes place in order from the tip surface of the sample, distribution in the depth direction of the atoms from the tip of the sample can be examined with the resolution of an atomic level.

Because this 3 DAP utilizes a high electric field, the sample to be analyzed should have high electro-conductivity of metal and the like, and the shape of the sample is generally required to be ultra fine needle shape with the tip diameter of approximately 100 nm diameter or less than that. Therefore, a sample is taken from the center part in the sheet thickness direction and the like of an aluminum alloy sheet that becomes an object to be measured, the sample is cut and electropolished by a precise cutting apparatus, and a sample having an ultra fine needle shape tip section for analysis is manufactured. As a measuring method, "LEAP 3000" made by Imago Scientific Instruments Corporation is used for example, high pulse voltage of 1 kV order is applied to the aluminum alloy sheet sample whose tip is formed into a needle shape, and several million pieces of atoms are continuously ionized from the tip of the sample. The ion is detected by the position sensitive type detector and is applied with pulse voltage. Mass spectroscopy of the ion (identification of the element that is the atomic species) is carried out based on the time of flight after the respective ions come out from the tip of the sample until reaching the detector.

Also, utilizing the characteristic that the electric field evaporation takes place regularly in order from the tip surface of the sample, a coordinate in the depth direction is properly given to a two-dimensional map that shows the arrival location of the atom, and three-dimensional mapping (construction of atomic structure: atom map in three dimensions) is executed using an analytical software "IVAS". Thus, a three-dimensional atom map of the tip of the sample can be obtained.

With respect to this three-dimensional atom map, the aggregate of atoms (cluster) is further analyzed using a Maximum Separation Method that is a method for defining an atom belonging to a precipitate and a cluster. In this analysis, the number of either of the Mg atom or the Si atom or both of them (30 pieces or more in total), the distance (space) between the Mg atom or the Si atom neighboring each other, and the number of either of the Mg atom or the Si atom having the predetermined narrow space (0.75 nm or less) are given as parameters.

Also, an aggregate of atoms in which either of Mg atoms or Si atoms or both of them are contained by 30 pieces or more in total, when any atom of the Mg atom or the Si atom included therein is made a reference, the distance between the atom of the reference and either atom out of neighboring other atoms is 0.75 nm or less, and these conditions are satisfied is defined to be the aggregate of atoms of the present invention. Then, the dispersion state of the aggregates of atoms matching this definition is evaluated, and is measured and quantified as the average density per 1 $\mu m^3$ (pieces/$\mu m^3$) by averaging the number density of the aggregates of atoms for 3 or more measurement samples.

(Detection Efficiency of Atom by 3 DAP)

However, with respect to the detection efficiency of atom by these 3 DAP, approximately 50% out of the ionized atoms is the limit at present, and remaining atoms cannot be detected. When this detection efficiency of atom by the 3 DAP largely changes by improvement in the future and the like, the measurement result by the 3 DAP of the average number density (pieces/$\mu m^3$) of the aggregates of atoms stipulated by the present invention may possibly change. Therefore, in order to assure the reproducibility in measurement of the average number density of the aggregates of atoms, it is preferable to make the detection efficiency of atom by the 3 DAP generally constant at approximately 50%.

(Cluster Measurement of Sheet)

Measurement of the cluster by these 3 DAP is executed for arbitrary 10 locations in the center part in the thickness direction of the Al—Mg—Si-based aluminum alloy sheet after subjecting to refining, and these respective measured values of the number density are averaged to obtain the average number density stipulated in the present invention.

(Aluminum Alloy Sheet Microstructure)

As described above, the aluminum alloy sheet of the present invention is a sheet after being subjected to refining such as solution heat treatment and quenching treatment and the like after rolling, and means a sheet before being subjected to forming work into a panel by press forming and the like. In order to suppress room temperature aging when left at room temperature for a comparatively long period of time of approximately 0.5-4 months before press forming, it is a matter of course that the microstructure state of the sheet after being subjected to refining before being left at room temperature should be made the microstructure stipulated in the present invention.

(Stipulation of Cluster of the Present Invention)

First, the microstructure in an arbitrary center part in the thickness direction of the Al—Mg—Si-based aluminum alloy sheet after subjecting to refining such as solution heat treatment and quenching treatment before being left at room temperature described above is measured by the method described above by a three-dimensional atom probe field ion microscope. As the aggregate of atoms present in the measured microstructure, according to the present invention, first, the aggregate of atoms is to contain either of Mg atoms or Si atoms or both of them by 30 pieces or more in total. Also, the number of pieces of the Mg atoms and the Si atoms contained in the aggregate of atoms is preferable to be as much as possible, and the upper limit thereof is not particularly stipulated, however, from the manufacturing limit, the upper limit of the number of pieces of the Mg atoms and the Si atoms contained in the aggregate of atoms is approximately 10,000 pieces.

Further, one in which, when any atom of the Mg atom or the Si atom contained therein in the aggregate of atoms is made a reference, the distance between the atom of the reference and either atom out of neighboring other atoms is 0.75 nm or less is made the aggregate of atoms stipulated in the present invention (satisfying the stipulation of the present invention). This distance 0.75 nm therebetween is a figure determined in order to assure the number density of the aggregates of atoms (clusters) in which the distance between atoms of Mg and Si is short and there is the BH properties improvement effect in a short period of time at a low temperature after room temperature aging for a long period of time. Until now, the present inventors have investigated in detail the relation between the aluminum alloy sheet capable of exerting high BH properties even in the vehicle body baking finish treatment under a condition shortened at a low temperature and the aggregates of an atomic level. As a result, it was found out experimentally that high number density of the aggregates of atoms stipulated by the definition described above represents the form of the microstructure exerting high BH properties. Therefore, although the technical implication of the distance 0.75 nm between atoms has not been clarified sufficiently, it is necessary in order to strictly assure the number density of the aggregates of atoms which exert high BH properties, and is a figure determined for the purpose.

Besides, according to the present invention, the aggregates of atoms satisfying these conditions (stipulated in the present invention) are to be contained by the average number density of $1.0\times10^5$ pieces/$\mu m^3$ or more. Also, the average number density of the aggregates of atoms is preferable to be as high as possible, and the upper limit thereof is not particularly stipulated, however, from the manufacturing limit, the average number density of the aggregates of atoms is approximately $1.0\times10^6$ pieces/$\mu m^3$ in general.

With respect to the aggregate of atoms (cluster) stipulated in the present invention, the case both of the Mg atoms and the Si atoms are contained is most often, however the case the Mg atoms are contained but the Si atoms are not contained and the case the Si atoms are contained but the Mg atoms are not contained are also included. Further, the aggregate of atoms (cluster) stipulated in the present invention is not always constituted only of the Mg atoms and the Si atoms, and Al atoms are contained with very high probability in addition to them.

Also, according to the componential composition of the aluminum alloy sheet, a case inevitably occurs in which atoms such as Fe, Mn, Cu, Cr, Zr, V, Ti or Zn and the like contained as alloy elements and impurities are contained in the aggregate of atoms and these other atoms are counted by the 3 DAP analysis. However, even when these other atoms (derived from the alloy elements and impurities) may be contained in the aggregate of atoms, they are in a less level compared to the total number of pieces of the Mg atoms and the Si atoms. Therefore, even when such other atoms are contained in the aggregate, those satisfying the stipulation (condition) function similarly as the aggregate of atoms formed of only the Mg atoms and the Si atoms does as the aggregate of atoms of the present invention. Accordingly, as far as the stipulation described above is satisfied, the aggregate of atoms stipulated in the present invention may contain any atoms in addition.

Also, "when any atom of the Mg atom or the Si atom contained therein is made a reference, the distance between the atom of the reference and either atom out of neighboring other atoms is 0.75 nm or less" of the present invention means that all of the Mg atoms and the Si atoms present in the aggregate of atoms has at least one Mg atom and Si atom with the distance therebetween being 0.75 nm or less in the periphery thereof.

With respect to the stipulation on the distance between atoms in the aggregate of atoms of the present invention, when any atom of the Mg atom or the Si atom contained therein is made a reference, all of the distances between the atom of the reference and all atoms of the neighboring other atoms are not necessarily be 0.75 nm or less respectively, and, adversely, all of them may be 0.75 nm or less respectively. In other words, other Mg atom or Si atom whose distance exceeds 0.75 nm may be neighbor, and at least one piece of other Mg atom or Si atom satisfying the stipulated distance (space) only has to be present around the specific Mg atom or Si atom (Mg atom or Si atom of the reference).

Also, when one piece of neighboring other Mg atom or Si atom that satisfies this stipulated distance is present, the number of pieces of the Mg atom or Si atom that should be counted satisfying the condition of the distance becomes 2 pieces including the specific Mg atom or Si atom (Mg atom or Si atom of the reference). Further, when 2 pieces of neighboring other Mg atom or Si atom that satisfy this stipulated distance are present, the number of pieces of the Mg atom or Si atom that should be counted satisfying the condition of the distance becomes 3 pieces including the specific Mg atom or Si atom (Mg atom or Si atom of the reference).

The cluster described above is a cluster formed by reheating treatment after the solution heat treatment and quenching treatment described above and described below in detail. Until now, it has been reported that a cluster promoting precipitation of a GP zone or a β' phase that increases the strength in artificial aging or baking finish treatment is a Mg/Si cluster as described above and this cluster is formed by heat treatment of 50-150° C. after the solution heat treatment and quenching treatment, whereas a cluster suppressing precipitation of a GP zone or a B' phase in artificial aging or baking finish treatment is an Si-rich cluster, and this cluster is formed by retention at room temperature (room temperature aging) after the solution heat treatment and quenching treatment (described for example in Sato, Keikinzoku (Light Metal), vol. 56, p. 595). However, as a result of the detailed analysis by the present inventors on the relation between the strength at the time of the artificial aging treatment or at the time of the baking finish treatment and the cluster, it was found out that the structural factor contributing to the strength at the time of the artificial aging treatment or at the time of the baking finish treatment was not the kind (composition) of the cluster but was the size. Further, correspondence of the size and the number density of the cluster to the strength at the time of the artificial aging treatment or the baking finish treatment also was clarified only by the analysis with the definition described above.

Out of both of these clusters (aggregates of atoms), one formed by reheating treatment after solution heat treatment and quenching treatment is the cluster of the present invention. That is the cluster in which, an aggregate of atoms thereof contain either of Mg atoms or Si atoms or both of them by 30 pieces or more in total, and, when any atom of the Mg atom or the Si atom contained therein is made a reference, the distance between the atom of the reference and either atom out of neighboring other atoms is 0.75 nm or less.

On the other hand, the clusters formed by retention at room temperature (room temperature aging) described above have the number of pieces of the atoms and the number density of the clusters deviating from the stipulation of the present invention described above although they are the aggregates of atoms in measurement by a three-dimensional atom probe field ion microscope. Therefore, the stipulation on the clusters (aggregates of atoms) of the present invention is also a stipulation discriminating the clusters from those formed by retention at room temperature (room temperature aging) described above and preventing added (contained) Mg and Si from being consumed by these clusters.

When the average number density of the clusters (aggregates of atoms) stipulated in the present invention described above is less than $1.0\times10^5$ pieces/$\mu m^3$, the formation amount of the clusters themselves becomes insufficient which means that plenty of added (contained) Mg and Si are consumed by the clusters formed by the room temperature aging described above.

Therefore, even though there may be an effect of promoting precipitation of a GP zone or a β' phase and improving the BH properties, after being left at room temperature (room temperature aging) for a long period of time, improvement of the BH properties when the baking finish treatment is shortened at a low temperature such as 150° C.×20 min remains approximately 30-40 MPa compared with the past in terms of 0.2% proof stress. Accordingly, desired higher BH properties cannot be secured under such condition.

(Chemical Componential Composition)

Next, the chemical componential composition of the 6000 series aluminum alloy sheet will be described below. With respect to the 6000 series aluminum alloy sheet that is the object of the present invention, various properties such as excellent formability, BH properties, strength, weldability, corrosion resistance and the like are required as a sheet for an outer sheet of an automobile and the like described above.

In order to satisfy such requirement, the composition of the aluminum alloy sheet is to contain Mg: 0.2-2.0% and Si: 0.3-2.0% in mass % with the remainder being Al and inevitable impurities. Also, all of the % indications of the content of each element mean mass %.

The 6000 series aluminum alloy sheet of the object of the present invention is preferable to be such an excess-Si type 6000 series aluminum alloy sheet with superior BH properties and 1 or more mass ratio Si/Mg of Si and Mg. The 6000 series aluminum alloy sheet secures the formability by lowering the proof stress at the time of press forming and bending work, and has excellent age-hardenability (BH properties) with which the proof stress increases by age hardening by heating at the time of artificial aging treatment at a comparatively low temperature such as baking finish treatment and the like of a panel after forming, and required strength can be secured. Among them, the excess-Si type 6000 series aluminum alloy sheet is superior in the BH properties in comparison to the 6000 series aluminum alloy sheet with less than 1 mass ratio Si/Mg.

According to the present invention, elements other than these Mg and Si are basically impurities or elements that may be contained, and are to have the content of each element level (allowable amount) in line with the AA and JIS Standards and the like.

More specifically, in the present invention also, when not only the high purity Al matrix but also the 6000 series alloy, other aluminum alloy scrap material, low purity Al matrix and the like containing elements other than Mg and Si by much amount as additive elements (alloy elements) are used by much amount as the melting raw material of an alloy from the viewpoint of resources recycling, other elements described below are inevitably mixed in by a substantial amount. Also, refining itself that daringly reduces these elements involves cost increase, and inclusion of them to some extent should be allowed. Further, even when a substantial amount may be contained, there is an inclusion range not impeding the object and effect of the present invention.

Accordingly, in the present invention, inclusion of such elements described below is allowed in a range of an upper limit amount or less in line with the AA and JIS Standards and the like stipulated respectively as described below. More specifically, one element or two elements or more of Mn: 1.0% or less (not including 0%), Cu: 1.0% or less (not including 0%), Fe: 1.0% or less (not including 0%), Cr: 0.3% or less (not including 0%), Zr: 0.3% or less (not including 0%), V: 0.3% or less (not including 0%), Ti: 0.05% or less (not including 0%), and Zn: 1.0% or less (not including 0%) may be further contained in these ranges in addition to the fundamental composition described above.

The inclusion range and importance or the allowable amount of each element in the 6000 series aluminum alloy will be described below.

Si: 0.3-2.0%

Along with Mg, Si is an important element in forming the cluster stipulated in the present invention. Also, Si is an indispensable element for exerting strengthening of solid solution and age-hardenability by forming aging precipitates contributing to improvement of the strength at the time of the artificial aging treatment at a low temperature described above such as baking finish treatment and the like and securing the strength (proof stress) required as an outer panel of an automobile. Further, Si is the most important element for providing the 6000 series aluminum alloy sheet of the present invention with all of various properties such as the total elongation and the like affecting the press formability.

Also, in order to exert excellent age-hardenability in baking finish treatment at a lower temperature and a shorter period of time after forming into a panel, a 6000 series aluminum alloy composition with 1.0 or more mass ratio of Si/Mg and containing Si more excessively high relative to Mg than the generally called excess-Si type is preferable.

When the Si content is excessively low, because the absolute amount of Si is insufficient, the cluster stipulated in the present invention cannot be formed by the stipulated number density, and the baking finish hardenability extremely deteriorates. Also, various properties such as the total elongation and the like required for respective uses cannot be achieved simultaneously. On the other hand, when the Si content is excessively high, coarse constituents and precipitates are formed, and bending workability, total elongation and the like extremely deteriorate. Further, the weldability is also extremely impeded. Therefore, Si is to be made the range of 0.3-2.0%.

Mg: 0.2-2.0%

Along with Si, Mg also is an important element in forming the cluster stipulated in the present invention. Also, Mg is an indispensable element for exerting strengthening of solid solution and age-hardenability by forming aging precipitates contributing to improvement of the strength along with Si at the time of the artificial aging treatment described above such as baking finish treatment and the like and securing the proof stress required as a panel.

When the Mg content is excessively low, because the absolute amount of Mg is insufficient, the cluster stipulated in the present invention cannot be formed by the stipulated number density, and baking finish hardenability extremely deteriorates. Therefore, the proof stress required as a panel cannot be secured. On the other hand, when the Mg content is excessively high, coarse constituents and precipitates are formed, and bending workability, total elongation and the like extremely deteriorate. Therefore, Mg content is to be in the range of 0.2-2.0% and by such amount that Si/Mg becomes 1.0 or more in terms of a mass ratio.

(Manufacturing Method)

Next, a manufacturing method of the aluminum alloy sheet of the present invention will be described below. With respect to the aluminum alloy sheet of the present invention, the manufacturing process itself is by an ordinary method or widely known method, and it is manufactured by casting an aluminum alloy ingot having the 6000 series componential composition, thereafter executing homogenizing heat treatment, subjecting to hot rolling and cold rolling to obtain a predetermined sheet thickness, and further subjecting to refining treatment such as the solution heat treatment and quenching treatment.

However, in order to control the cluster of the present invention for improving the BH properties during these manufacturing processes, the reheating treatment condition after the solution heat treatment and quenching treatment should be controlled more properly as described below. Further in other processes also, there is also a preferable condition for controlling the cluster within the stipulated range of the present invention.

(Melting and Casting Cooling Rate)

First, in the melting and casting process, the aluminum alloy molten metal that has been molten so as to be adjusted within the 6000 series componential composition range is casted properly selecting ordinary melting and casting method such as a continuous casting method, semi-continuous casting method (DC casting method) and the like. Here, in order to control the cluster within the stipulated range of the present invention, it is preferable to make the average cooling rate in casting as high (quick) as possible at 30° C./min or more from the liquidus temperature to the solidus temperature.

When such temperature (cooling rate) control at a high temperature region in casting is not executed, the cooling rate at this high temperature region inevitably becomes slow. When the average cooling rate at the high temperature range becomes slow thus, the amount of the constituents formed coarse in the temperature range of this high temperature region increases, and the dispersion of the size and amount of the constituents in the sheet thickness direction and the width direction of the ingot increases. As a result, the possibility that the stipulated cluster cannot be controlled to the range of the present invention increases.

(Homogenizing Heat Treatment)

Next, the aluminum alloy ingot having been casted is subjected to homogenizing heat treatment prior to hot rolling. The object of this homogenizing heat treatment (soaking treatment) is homogenizing the microstructure, that is, to eliminate segregation within the crystal grains in the microstructure of the ingot. The treatment is not particularly limited as far as it is in the condition for achieving the object, and can be the treatment of ordinary once or one step.

The homogenizing heat treatment temperature is selected properly from the range of 500° C. or above and below the melting point, and the homogenizing time is selected properly from the range of 4 hours or more. When this homogenizing temperature is low, the segregation within the crystal grains cannot be eliminated sufficiently which acts as the fracture origin, and therefore the stretch flangeability and bending workability deteriorate. Even when hot rolling is started immediately thereafter or hot rolling is started after cooling to a proper temperature and being retained, it is possible to control the number density of the cluster to that stipulated in the present invention.

After execution of this homogenizing heat treatment, it is also possible to execute cooling to room temperature with the average cooling rate of 20-100° C./hr between 300° C.-500° C., then executing reheating to 350° C.-450° C. with the average heating rate of 20-100° C./hr, and to start hot rolling at this temperature range.

When the conditions of the average cooling rate after the homogenizing heat treatment and the reheating rate thereafter are deviated from, the possibility of formation of coarse Mg—Si compounds increases.

(Hot Rolling)

Hot rolling is constituted of a rough rolling process of an ingot (slab) and a finish rolling process according to the thickness of the sheet to be rolled. In these rough rolling process and finish rolling process, rolling mills such as a reverse type or tandem type are used properly.

At this time, under the condition the hot rolling (rough rolling) start temperature exceeds 450° C., the predetermined Mg—Si compounds stipulated in the present invention cannot be obtained. Also, when the hot rolling start temperature is below 350° C., execution of hot rolling itself becomes hard. Therefore, the hot rolling start temperature is to be in the range of 350-580° C., more preferably 350-450° C.

(Annealing of Hot Rolled Sheet)

Annealing before cold rolling (rough annealing) of this hot rolled sheet is not necessarily required, but may be executed in order to further improve the properties such as the formability and the like by miniaturizing the crystal grains and optimizing the texture.

(Cold Rolling)

In cold rolling, the hot rolled sheet is rolled and is manufactured into a cold rolled sheet (including a coil) of a desired final sheet thickness. However, in order to further miniaturize the crystal grains, cold rolling reduction ratio is preferable to be 60% or more, and intermediate annealing may be executed between cold rolling passes with an object similar to that of the rough annealing described above.

(Solution Heat Treatment and Quenching Treatment)

After the cold rolling, solution heat treatment and quenching treatment are executed. The solution heat treatment and quenching treatment can be executed by heating and cooling by an ordinary continuous heat treatment line, and are not particularly limited. However, because it is preferable to secure a sufficient solid solution amount of each element and that the crystal grain size is finer as described above, it is preferable to be executed under the condition of heating to the solution heat treatment temperature of 520° C. or above at the heating rate of 5° C./s or more, and being retained for 0-10 s.

Also, from the viewpoint of suppressing formation of coarse intergranular compounds that deteriorate the formability and hem workability, it is preferable to execute quenching at the cooling rate of 10° C./s or more. When the cooling rate is slow, Si, $Mg_2Si$ and the like are liable to precipitate on the grain boundary, they are liable to become the start point of a crack at the time of press forming and bending work, and these formabilities deteriorate. In order to secure this cooling rate, for the quenching treatment, air cooling by a fan and the like, water cooling means of the mist, spray, immersion and the like and conditions are selectively used respectively.

(Reheating Treatment)

After the quenching cooling to room temperature, the cold rolled sheet is subjected to reheating treatment within one hour. In the reheating treatment, the cold rolled sheet is reheated to the temperature range of 70-130° C. at the average heating rate (temperature rising rate) of 1° C./second (s) or more, is retained at the arrival reheating temperature for 0.2-1 hour, and is thereafter air-cooled to room temperature with the average cooling rate of 1-20° C./hr range.

By satisfying this condition, the microstructure having the predetermined number density of the cluster stipulated in the present invention can be secured. In other words, even when the reheating treatment is executed at the temperature, when even one of the stipulated conditions of the required time until reheating, heating rate (temperature rising rate), retention time and average cooling rate is not appropriate, the possibility that the number density of the cluster does not become that stipulated in the present invention increases.

Here, when the retention (leaving) time at room temperature after finish of cooling for quenching until the reheating treatment exceeds 1 hour and the average heating rate (temperature rising rate) is less than 1° C./second (s), the cluster shaped by retention at room temperature (room temperature aging) is formed first, the predetermined number density of the cluster stipulated in the present invention cannot be secured, and the bake hardenability at a low temperature and a short period of time after the room temperature aging cannot be secured. Among them, the retention (leaving) time at room temperature after finish of cooling for quenching until the reheating treatment is preferable to be shorter. Also, the average heating rate (temperature rising rate) is preferable to be quicker, and is preferable to be 1° C./second (s) or more, more preferably 5° C./second (s) or more by a high speed heating means such as high frequency heating and the like.

Even when the reheating temperature is below 70° C., the predetermined cluster density stipulated in the present invention cannot be secured, and the bake hardenability at a low temperature and a short period of time after the room temperature aging cannot be secured. Also, under the condition that the heating temperature exceeds 130° C., the clusters are formed so as to exceed the predetermined cluster density stipulated in the present invention, or an intermetallic compound phase such as β' which is different from the cluster is formed, and the formability and bending workability are deteriorated.

In the reheating treatment, in addition to the reheating temperature, the average heating rate (temperature rising rate), retention time at the reheating arrival temperature, and average cooling rate thereafter also largely affect formation of the predetermined number density of the cluster stipulated in the present invention. When the average heating rate is excessively slow, the retention time is excessively short, or the average cooling rate after reheating is excessively quick, the predetermined density of the cluster stipulated in the present invention cannot be secured, and the bake hardenability at a low temperature and a short period of time after the room temperature aging cannot be secured. Also, when the retention time is excessively long, there is a possibility that the clusters are formed so as to exceed the predetermined cluster density stipulated in the present invention or the intermetallic compound phase such as β which is different from the cluster is formed, and the formability and bending workability are deteriorated.

Below, the present invention will be described more specifically referring to examples, however, the present invention is not limited by the examples described below and can be also implemented with modifications being added appropriately within the scope adaptable to the purposes described above and below, and any of them is to be included within the technical range of the present invention.

EXAMPLES

Next, examples of the present invention will be described. The 6000 series aluminum alloy sheets with different cluster condition stipulated in the present invention were manufactured separately, and the BH properties (baking finish hardenability) at a low temperature and a short period of time after the room temperature aging for a long period of time were evaluated respectively. Further, the hem workability as the press formability and bending workability was also evaluated.

More specifically, the 6000 series aluminum alloy sheets shown in Table 1 were manufactured variously changing the reheating treatment condition after the solution heat treatment and quenching treatment as shown in Table 2. Also, in the indication of the content of each element in Table 1, the indication where the figure in each element is blank shows that the content is equal to or less than the detection limit.

The concrete manufacturing condition of the aluminum alloy sheets is as described below. The ingots of respective compositions shown in Table 1 were molten commonly by the DC casting method. At this time, commonly to respective examples, the average cooling rate in casting was made 50° C./min from the liquidus temperature to the solidus temperature.

Then, the ingot was subjected to soaking treatment of 560° C.×4 hrs commonly to respective examples, and hot rough rolling was thereafter started. Further, commonly to respective examples, in the finish rolling that followed, hot rolling was executed to the thickness of 3.5 mm to obtain the hot rolled sheet (coil). The aluminum alloy sheet after hot rolling was cold rolled without rough annealing after hot rolling and without intermediate annealing in the middle of cold rolling commonly to respective examples, and the cold rolled sheet (coil) of the thickness of 1.0 mm was obtained commonly to respective examples.

Also, commonly to respective examples, each of the cold rolled sheet was heated to the solution heat treatment temperature of 550° C. with the average heating rate up to 500° C. of 10° C./s by a continuous type heat treatment facility, and was subjected to the solution heat treatment and quenching treatment immediately by cooling to room temperature with the average cooling rate of 50° C./s. Thereafter, the reheating treatment was executed by heating and cooling under the respective conditions shown in Table 2 which were different among the respective examples.

The sample sheet (blank) was cut out from each final product sheet after being left at room temperature for 2 months after the refining treatment, and the microstructure of each sample sheet was measured and evaluated. These results are shown in Table 2.

(Cluster)

The microstructure in the center part in the sheet thickness direction of the sample sheet after being left at room temperature for 2 months after the refining treatment was analyzed by the 3 DAP method described above, and the average number density (pieces/$\mu m^2$) of the cluster stipulated in the present invention was obtained.

(Baking Finish Hardenability)

The 0.2% proof stresses of each sample sheet after being left at room temperature for 2 months after the refining treatment and the sample sheet after subjecting to the artificial age hardening treatment (after baking) at a low temperature and a short period of time of 150° C. and 20 min commonly to each of them were compared to each other, and the BH properties were evaluated from the difference thereof (increment of the proof stress).

With respect to the tensile test method, No. 5 specimen (25 mm×50 mm GL×sheet thickness) of JIS Z 2201 was respectively taken from each sample sheet, and the tensile test at room temperature was executed. The tensile direction of the specimen then was made the direction orthogonal to the rolling direction. The tensile rate was made 5 mm/min to the 0.2% proof stress and 20 mm/min at the proof stress and onward. The N number of the measurement of the mechanical properties was made 5, and the average values were calculated respectively.

(Hem Workability)

The hem workability was evaluated only for respective sample sheets after being left at room temperature for 2 months after the refining treatment. In the test, a strip-like specimen with 30 mm width was used, 90° bending work of inward bending with 1.0 mm radius by a down flange was executed, an inner with 1.0 mm thickness was thereafter sandwiched, and the pre-hem working of further bending the bent part inward to approximately 130° in order and the flat hem working of bending the bent part by 180° and making the end part tightly attach the inner were executed.

The surface state such as the rough surface, occurrence of a minute crack and a large crack of the bent part (edge bent part) of the flat hem was visually observed, and was visually evaluated by the criteria described below.

0; without crack and without rough surface, 1; slight rough surface, 2; deep rough surface, 3; minute surface crack, 4; linearly continued surface crack, 5; breakage As shown in Tables 1-2, respective invention examples have been subjected to manufacturing and refining treatment within the componential composition range of the present invention and within the preferable condition range. Therefore, as shown in Table 2, the respective invention examples satisfy the cluster condition stipulated in the present invention.

As a result, the respective invention examples are excellent in the BH properties even after the room temperature aging for a long period of time after the refining treatment and baking finish hardened at a low temperature and for a short period of time. Also, even after the room temperature aging for a long period of time after the refining treatment, the respective invention examples are excellent in the hem workability.

On the other hand, the comparative examples 14-20 of Table 2 use the invented alloy example No. 2 of Table 1. However, as shown in Table 2, in these comparative examples, the solution heat treatment condition and the reheating treatment condition deviate from the preferable range. As a result, in these comparative examples, the condition of the cluster stipulated in the present invention deviates, and the BH properties are inferior.

The comparative examples 21, 22, 23, 27 of Table 2 have been manufactured within the preferable range including the reheating treatment condition, however the content of Mg or Si which is the indispensable element deviated from the range of the present invention respectively. Therefore, the condition of the cluster stipulated in the present invention deviates, and the BH properties are inferior as shown in Table 2.

Further, in the comparative examples 24, 25, 26, 28 of Table 2 also, the condition of the cluster stipulated in the present invention deviates, and the BH properties are inferior.

Accordingly, from the result of the examples described above, the critical importance and effect of the respective requirements on the composition and microstructure or the preferable manufacturing condition in the present invention for achieving both of the BH properties under the condition of a low temperature and a short period of time after the room temperature aging for a long period of time and the formability after the room temperature aging for a long period of time are endorsed.

TABLE 1

| Classification | Alloy No. | Chemical composition of Al—Mg—Si alloy sheet (mass %, remainder: Al) Mg | Si | Fe | Mn | Cr | Zr | V | Ti | Cu | Zn |
|---|---|---|---|---|---|---|---|---|---|---|---|
| Invention example | 1 | 0.6 | 0.8 | 0.2 | | | | | | | |
| | 2 | 0.5 | 1.2 | 0.2 | | | | | 0.01 | | |
| | 3 | 0.4 | 1.1 | 0.9 | | | | | 0.05 | | |
| | 4 | 0.6 | 1.6 | 0.15 | 0.05 | | | | | | |
| | 5 | 0.3 | 1.7 | 0.4 | | 0.05 | | | | | |
| | 6 | 0.5 | 1.3 | 0.2 | 0.1 | | 0.2 | | | | |
| | 7 | 0.9 | 0.7 | 0.2 | | 0.3 | | 0.05 | | | |
| | 8 | 0.7 | 1.4 | 0.5 | 0.05 | | | | | 1 | |
| | 9 | 1.3 | 0.6 | 0.2 | 0.3 | | 0.05 | | | | |
| | 10 | 0.7 | 1.0 | 0.2 | | 0.1 | | 0.3 | | | |
| | 11 | 0.5 | 1.3 | 0.3 | | | | | | 0.2 | |
| | 12 | 0.5 | 0.8 | 0.6 | 0.05 | | | | | | 1 |
| | 13 | 0.6 | 1.4 | 0.25 | | | 0.05 | | | | 0.2 |
| Comparative example | 14 | 0.15 | 1.1 | 0.2 | | | | | | | |
| | 15 | 0.5 | 2.3 | 0.25 | 0.05 | | | | | | |
| | 16 | 0.8 | 0.2 | 0.2 | 0.1 | | | | | | |
| | 17 | 0.5 | 0.5 | 1.2 | | | | | | | |
| | 18 | 0.5 | 1.2 | 0.5 | 1.1 | | | | | | |
| | 19 | 0.6 | 1.2 | 0.3 | | 0.4 | | | 0.1 | | |
| | 20 | 2.4 | 0.6 | 0.2 | | | | | | 1.2 | |
| | 21 | 0.7 | 1.0 | 0.4 | | | 0.4 | 0.4 | | | 1.2 |

* The cell where the figure of each element is blank means the detection limit or less.

TABLE 2

| Solution heat treatment and quenching treatment | | | | | Reheating treatment | | | | |
|---|---|---|---|---|---|---|---|---|---|
| Classification | No. | Alloy No in Table 1 | Solution heat treatment temperature ° C. | Cooling rate ° C./s | Required time until reheating s | Heating rate ° C./s | Arrival temperature ° C. | Retention time hr | Cooling rate ° C./hr |
| Invention example | 1 | 1 | 540 | 100 | 600 | 2 | 100 | 0.6 | 5 |
| | 2 | 2 | 550 | 60 | 1200 | 5 | 80 | 1 | 15 |
| | 3 | 3 | 545 | 80 | 300 | 20 | 120 | 0.3 | 10 |
| | 4 | 4 | 525 | 100 | 120 | 50 | 90 | 0.5 | 20 |
| | 5 | 5 | 540 | 70 | 360 | 10 | 130 | 0.2 | 10 |

TABLE 2-continued

| | | Solution heat treatment and quenching treatment | | | | | | | |
|---|---|---|---|---|---|---|---|---|---|
| | 6 | 6 | 530 | 90 | 240 | 30 | 75 | 1 | 5 |
| | 7 | 7 | 555 | 40 | 900 | 15 | 110 | 0.8 | 20 |
| | 8 | 8 | 530 | 85 | 1800 | 2 | 95 | 0.4 | 10 |
| | 9 | 9 | 525 | 50 | 60 | 80 | 120 | 0.6 | 15 |
| | 10 | 10 | 525 | 110 | 300 | 40 | 100 | 0.3 | 10 |
| | 11 | 11 | 540 | 80 | 1200 | 10 | 85 | 0.9 | 20 |
| | 12 | 12 | 560 | 30 | 600 | 5 | 105 | 0.5 | 5 |
| | 13 | 13 | 535 | 100 | 180 | 50 | 100 | 0.7 | 15 |
| Comparative example | 14 | 2 | 500 | 80 | 1200 | 5 | 90 | 0.6 | 15 |
| | 15 | 2 | 540 | 5 | 1200 | 5 | 90 | 0.6 | 15 |
| | 16 | 2 | 540 | 80 | 7200 | 5 | 90 | 0.6 | 15 |
| | 17 | 2 | 540 | 80 | 1200 | 0.1 | 90 | 0.6 | 15 |
| | 18 | 2 | 540 | 80 | 1200 | 5 | 55 | 0.6 | 15 |
| | 19 | 2 | 540 | 80 | 1200 | 5 | 90 | 0.05 | 20 |
| | 20 | 2 | 540 | 80 | 1200 | 5 | 90 | 0.6 | 30 |
| | 21 | 14 | 540 | 80 | 1200 | 5 | 90 | 0.6 | 15 |
| | 22 | 15 | 540 | 80 | 1200 | 5 | 90 | 0.6 | 15 |
| | 23 | 16 | 540 | 80 | 1200 | 5 | 90 | 0.6 | 15 |
| | 24 | 17 | 540 | 80 | 1200 | 5 | 90 | 0.6 | 15 |
| | 25 | 18 | 540 | 80 | 1200 | 5 | 90 | 0.6 | 15 |
| | 26 | 19 | 540 | 80 | 1200 | 5 | 90 | 0.6 | 15 |
| | 27 | 20 | 540 | 80 | 1200 | 5 | 90 | 0.6 | 15 |
| | 28 | 21 | 540 | 80 | 1200 | 5 | 90 | 0.6 | 15 |

| | | Microstructure and properties of aluminum alloy sheet after refining | | | | | |
|---|---|---|---|---|---|---|---|
| Classification | No. | Average number density of cluster $\times 10^5$ pieces/$\mu m^3$ | As proof stress (0.2%) MPa | Proof stress after BH (0.2%) MPa | BH properties (increment of proof stress) MPa | As total elongation % | Hem workability |
| Invention example | 1 | 4.52 | 125 | 190 | 65 | 28 | 1 |
| | 2 | 4.89 | 127 | 195 | 68 | 28 | 1 |
| | 3 | 6.53 | 128 | 223 | 95 | 27 | 1 |
| | 4 | 6.31 | 126 | 218 | 92 | 28 | 1 |
| | 5 | 6.46 | 127 | 224 | 97 | 27 | 1 |
| | 6 | 5.19 | 122 | 195 | 73 | 28 | 1 |
| | 7 | 5.02 | 132 | 202 | 70 | 28 | 2 |
| | 8 | 2.72 | 130 | 188 | 58 | 28 | 2 |
| | 9 | 7.96 | 129 | 228 | 99 | 28 | 1 |
| | 10 | 6.44 | 125 | 219 | 94 | 28 | 1 |
| | 11 | 5.37 | 124 | 199 | 75 | 28 | 1 |
| | 12 | 4.92 | 133 | 202 | 69 | 29 | 2 |
| | 13 | 6.85 | 131 | 229 | 98 | 28 | 2 |
| Comparative example | 14 | 0.54 | 121 | 163 | 42 | 26 | 1 |
| | 15 | 0.47 | 120 | 161 | 41 | 25 | 3 |
| | 16 | 0.32 | 132 | 162 | 30 | 27 | 2 |
| | 17 | 0.37 | 130 | 163 | 33 | 27 | 2 |
| | 18 | 0.33 | 134 | 166 | 32 | 28 | 3 |
| | 19 | 0.95 | 124 | 169 | 45 | 26 | 2 |
| | 20 | 0.92 | 122 | 166 | 44 | 27 | 2 |
| | 21 | 0.28 | 107 | 134 | 27 | 25 | 1 |
| | 22 | 0.96 | 138 | 184 | 46 | 25 | 5 |
| | 23 | 0.12 | 116 | 139 | 23 | 26 | 1 |
| | 24 | 0.93 | 129 | 174 | 45 | 27 | 5 |
| | 25 | 0.98 | 148 | 192 | 44 | 25 | 5 |
| | 26 | 0.96 | 132 | 176 | 44 | 26 | 4 |
| | 27 | 0.88 | 125 | 164 | 39 | 27 | 4 |
| | 28 | 0.97 | 127 | 170 | 43 | 26 | 5 |

The present invention has been described in detail and referring to specific embodiments, however, it is clear for a person with an ordinary skill in the art that various alterations and modifications can be added without departing from the spirit and scope of the present invention.

The present application is based on the Japanese Patent Application No. 2011-056960 applied on Mar. 15, 2011, and the contents thereof are hereby incorporated by reference.

INDUSTRIAL APPLICABILITY

According to the present invention, a 6000 series aluminum alloy sheet achieving both of the BH properties under the condition of a low temperature and a short period of time after room temperature aging for a long period of time and the formability after room temperature aging for a long period of time can be provided. As a result, application of the 6000 series aluminum alloy sheet can be expanded as members and components of an automobile, transportation machine such as a marine vessel or a vehicle, household electric appliance, building and structure, and particularly to the member of a transportation machine such as an automobile.

The invention claimed is:

1. An Al—Mg—Si-based aluminum alloy sheet, comprising:

Mg: 0.2-2.0 mass %,

Si: 0.3-2.0 mass %, and

Al, wherein the Al—Mg—Si based aluminum alloy sheet is obtained by a process comprising a reheating treatment, in which a retention time at a reheating temperature of 70-130° C. is 0.2-1 hr; and an average number density of aggregates of atoms satisfying the following conditions is at least $1.0\times10^5$ pieces/$\mu m^3$:

each of the aggregates measured by a three-dimensional atom probe field ion microscope comprises either Mg atoms or Si atoms or both of them by 30 pieces or more in total, and when any atom of the Mg atoms or the Si atoms comprised in each aggregate is made as a reference atom, a distance between the reference atom and at least one neighboring Mg or Si atom of the reference atom is 0.75 nm or less.

2. The Al—Mg—Si-based aluminum alloy sheet according to claim 1, further comprising at least one of Mn: 1.0 mass % or less, excluding 0%, Cu: 1.0 mass % or less, excluding 0%, Fe: 1.0 mass % or less, excluding 0%, Cr: 0.3 mass % or less, excluding 0%, Zr: 0.3 mass % or less, excluding 0%, V: 0.3 mass % or less, excluding 0%, Ti: 0.05 mass % or less, excluding 0%, and Zn: 1.0 mass % or less, excluding 0%.

3. The Al—Mg—Si-based aluminum alloy sheet according to claim 1, wherein a mass ratio of Si/Mg is 1.0 or more.

4. The Al—Mg—Si-based aluminum alloy sheet according to claim 1, obtained by the process comprising:

subjecting an aluminum alloy sheet to a solution heat treatment at a heat treatment temperature of at least 520° C. and a heating rate of at least 5° C./second and a quenching treatment at a cooling rate of at least 10° C./second, thereby obtaining a cold rolled sheet after quenching cooling to room temperature.

5. The Al—Mg—Si-based aluminum alloy sheet according to claim 4, obtained by the process further comprising:

subjecting the cold rolled sheet to the reheating treatment within an hour, wherein the reheating treatment comprises reheating the cold rolled sheet to the reheating temperature of 70-130° C. at an average heating rate of at least 1° C./second, retaining the cold rolled sheet at the reheating temperature for a period of the retention time, and subsequently air-cooling the cold rolled sheet to room temperature at an average cooling rate of 1-20° C./hour.

6. The Al—Mg—Si-based aluminum alloy sheet according to claim 1, comprising:

Mg: 1.3-2.0 mass %.

7. The Al—Mg—Si-based aluminum alloy sheet according to claim 1, comprising:

Si: 1.6-2.0 mass %.

* * * * *